US005911254A

United States Patent [19]

Nishimoto

[11] Patent Number: 5,911,254

[45] Date of Patent: Jun. 15, 1999

[54] CLEANING APPARATUS FOR PHOTOSENSITIVE MATERIAL

[75] Inventor: Youji Nishimoto, Wakayama, Japan

[73] Assignee: Noritsu Koki Co., Ltd., Wakayama-ken, Japan

[21] Appl. No.: 08/838,496

[22] Filed: Apr. 7, 1997

[30] Foreign Application Priority Data

Apr. 9, 1996 [JP] Japan ..... 8-86119

[51] Int. Cl.[6] ..... B08B 1/02; B08B 11/00

[52] U.S. Cl. ..... 15/3; 15/100

[58] Field of Search ..... 15/1.51, 3, 100, 15/102

[56] References Cited

U.S. PATENT DOCUMENTS

| | | | |
|---|---|---|---|
| 1,398,811 | 11/1921 | Suhrcke | 15/100 |
| 2,305,011 | 12/1942 | Kienninger | 15/100 |
| 3,562,834 | 2/1971 | Stievenart et al. | 15/100 |
| 3,694,071 | 9/1972 | Touchette | 15/100 X |
| 3,714,882 | 2/1973 | Schranz et al. | 396/607 |
| 4,063,324 | 12/1977 | Junge | 15/100 |
| 4,303,330 | 12/1981 | Hehn et al. | 15/100 X |
| 4,740,075 | 4/1988 | Schoernig | 15/102 X |
| 4,947,029 | 8/1990 | Kurihara et al. | 15/102 X |

FOREIGN PATENT DOCUMENTS 0369805 5/1990 European Pat. Off. .

*Primary Examiner*—Mark Spisich
*Attorney, Agent, or Firm*—Fulbright & Jaworski, LLP

[57] ABSTRACT

A cleaning apparatus for cleaning photosensitive material (1) transported by a transport mechanism (26, 32) is disclosed. The apparatus includes a support portion (15) for supporting the photosensitive material from a back side thereof, a press roller (11) rotatable relative to the support portion for pressing the photosensitive material against the support portion, a drive mechanism (13) for rotatably driving the press roller and a control unit (30) for controlling rotational drive of the drive mechanism. The control unit (30) selectively provides a first mode where the photosensitive material is transported in association with rotation of the press roller and a second mode where a peripheral speed of the press roller is rendered different from a transport speed of the photosensitive material by the transport mechanism. In the second mode, dust present on the photosensitive material (1) is automatically removed by the press roller (11) due to friction generated between the surface of the photosensitive material (1) and the peripheral face of the press roller (11).

8 Claims, 7 Drawing Sheets

CLEANING APPARATUS FOR PHOTOSENSITIVE MATERIAL

BACKGROUND OF THE INVENTION

1. Field of the Invention

The present invention relates to a cleaning apparatus for cleaning photosensitive material transported by a transporting mechanism.

2. Description of the Related Art

Photosensitive material, such as a photographic film, is subjected, after its exposure with an image by means of a camera, to a development process by a developing device and then this developed film is subjected to a printing process for printing its developed image on to a print paper. As such photographic film, there is one known as shown in FIG. 4 for use in the new system commonly referred to as Advanced Photography System or APS for short. This film 1 includes, in addition to an image recording area 1*a*, an upper and lower pair of magnetic recording areas 1*b* disposed upwardly and downwardly of the image recording area for allowing reading and writing of various kinds of information to and from these areas. The information recording operation to the magnetic recording portions of the film is effected at the time of photography for recording such information including exposure conditions such as an exposure time period, an aperture value, use or non-use of a flash and such peripheral data as the date of photography and so on. Then, these pieces of recorded information are read by a magnetic head of a photographic processing system, which then develops and prints this film in accordance with the information read. Reversely, this magnetic head of the photographic processing system writes printing conditions used in the printing operation on to the print paper into the magnetic recording areas 1*b* of the film.

For assuring accuracy in the above-described information reading and writing operations between the magnetic recording areas of the photographic film and the magnetic head, it is necessary to remove 'dust' or any other foreign substance which may adhere to the surface of the photographic film. Especially, in the case of the developed film after the developing process, the 'dust' is understood to include excess developing liquid coagulated and deposited on the film surface. With adhesion such dust to the film, accurate reading and writing operation of the magnetic information may become impossible.

In order to solve the above problem, conventionally, when the film is discharged from the developing unit or the film is charged to the photographic processing system, an operator manually cleans the film surface by wiping it with cloth or the like.

However, such manual cleaning operation of the film by the operation is very troublesome and inefficient. Hence, there has been keen demand for improvement in this respect.

In view of the above-described state of the art, a primary object of the present invention is to provide a cleaning apparatus capable of automatically removing dust from the surface of photosensitive material through ingenious utilization of a transporting mechanism (e.g. a spool for taking up into a film cartridge the material after its development in the developing unit and an electric motor mechanism for rotatably driving the spool) incorporated in the developing unit (or photographic processing system).

SUMMARY OF THE INVENTION

For accomplishing the above-noted object, a cleaning apparatus for cleaning photosensitive material transported by a transport mechanism, according to the present invention, comprises:

a support portion for supporting the photosensitive material from a back side thereof;

a press roller rotatable relative to the support portion for pressing the photosensitive material against the support portion;

drive means for rotatably driving the press roller; and control means for controlling rotational drive of the drive means, the control means selectively providing a first mode where the photosensitive material is transported in association with rotation of the press roller and a second mode where a peripheral speed of the press roller is rendered different from a transport speed of the photosensitive material by the transport mechanism.

In the above, it is understood that the peripheral speed of the press roller rendered 'different' from the transport speed of the photosensitive material may include: a condition in which the press roller is maintained substantially still; a further condition in which a peripheral face of the press roller contacting the photosensitive material is moved in the opposite direction to the direction of transport of the photosensitive material by the transport mechanism; and a still further condition in which the peripheral face of the press roller contacting the photosensitive material is moved in the same direction as but at a higher speed than the transportation of the photosensitive material by the transport mechanism.

With the above-described construction, in the first mode, the normal transporting operation of the photosensitive material is effected by the press roller (e.g. a transporting operation for transporting an end of the photosensitive material to the transport mechanism to be connected with this mechanism). Whereas, in the second mode, the press roller can function to remove dust sticking to the photosensitive material. More particularly, in this second mode, in the course of transportation of the photosensitive material as being bound between the support portion and the press roller, because of the difference between the peripheral speed of the press roller and the transport speed of the material provided by the transport mechanism, there occurs friction between the surface of the press roller and the surface of the photosensitive material, so that dust present on the material surface may be automatically removed.

According to one aspect of the present invention, of the above-described three possible conditions which may be employed as the peripheral speed of the press roller rendered 'different' from the transport speed of the photosensitive material, the control means provides, as the second mode, the condition in which the press roller is maintained substantially still. This construction is advantageous in that the necessary friction between the press roller and the photosensitive material may be provided more reliably and further in that the control operation is easy. In order to stop the press roller reliably to obtain the friction, it is conceivable to provide an electric motor as drive means for driving the press roller. Then, this electric motor may be stopped by simply cutting off power supply thereto. However, while the above method may prove satisfactory in the case of certain types of electric motor, in most cases, it is preferred to apply some positive braking force to the press roller or to the electric motor. One conceivable method to apply such braking force in a reliable and rational fashion is to maintain the electric motor under a magnetically excited state. Still preferably, if the electric motor is a pulse motor and the magnetically excited condition is provided to this pulse motor, more reliable braking force may be obtained.

According to a still further aspect of the present invention, the cleaning apparatus further comprises a feed roller disposed upstream of the press roller in a transport passage of the photosensitive material along which the material is transported by the transport mechanism, and before the cleaning operation of the photosensitive material in the second mode, the control means drives the feed roller while maintaining the press roller still, so as to form a loop of the photosensitive material. With such formation of loop of the photosensitive material, it is possible to temporarily retain the photosensitive material under a waiting state before its dust cleaning operation. Namely, the above construction allows the feeding operation and the cleaning operation of the material to be carried out independently of each other. As a result, the cleaning operation on the photosensitive material may be done in a still more reliable manner.

According to a still further aspect of the present invention, the cleaning apparatus further comprises a roller cleaner for taking off the dust collected on the outer peripheral face of the press roller. With this, it is possible to prevent accumulation of dust on the press roller. Hence, the apparatus can continuously provide both proper cleaning function and transporting function of the photosensitive material for a longer period of time.

According to a still further aspect of the present invention, the photosensitive material is stored into a cartridge attached to a terminal end of the transport passage, and the dust cleaning operation is effected in association with this storing operation of the material into within the cartridge. With this, the storing operation of the material into the cartridge and the cleaning operation of the same may be effected simultaneously. Thus, the operational efficiency may be further improved.

Further and other objects, features and effects of the invention will become more apparent from the following more detailed description of the embodiments of the invention with reference to the accompanying drawings.

DESCRIPTION OF THE PREFERRED EMBODIMENTS

Figure 1:
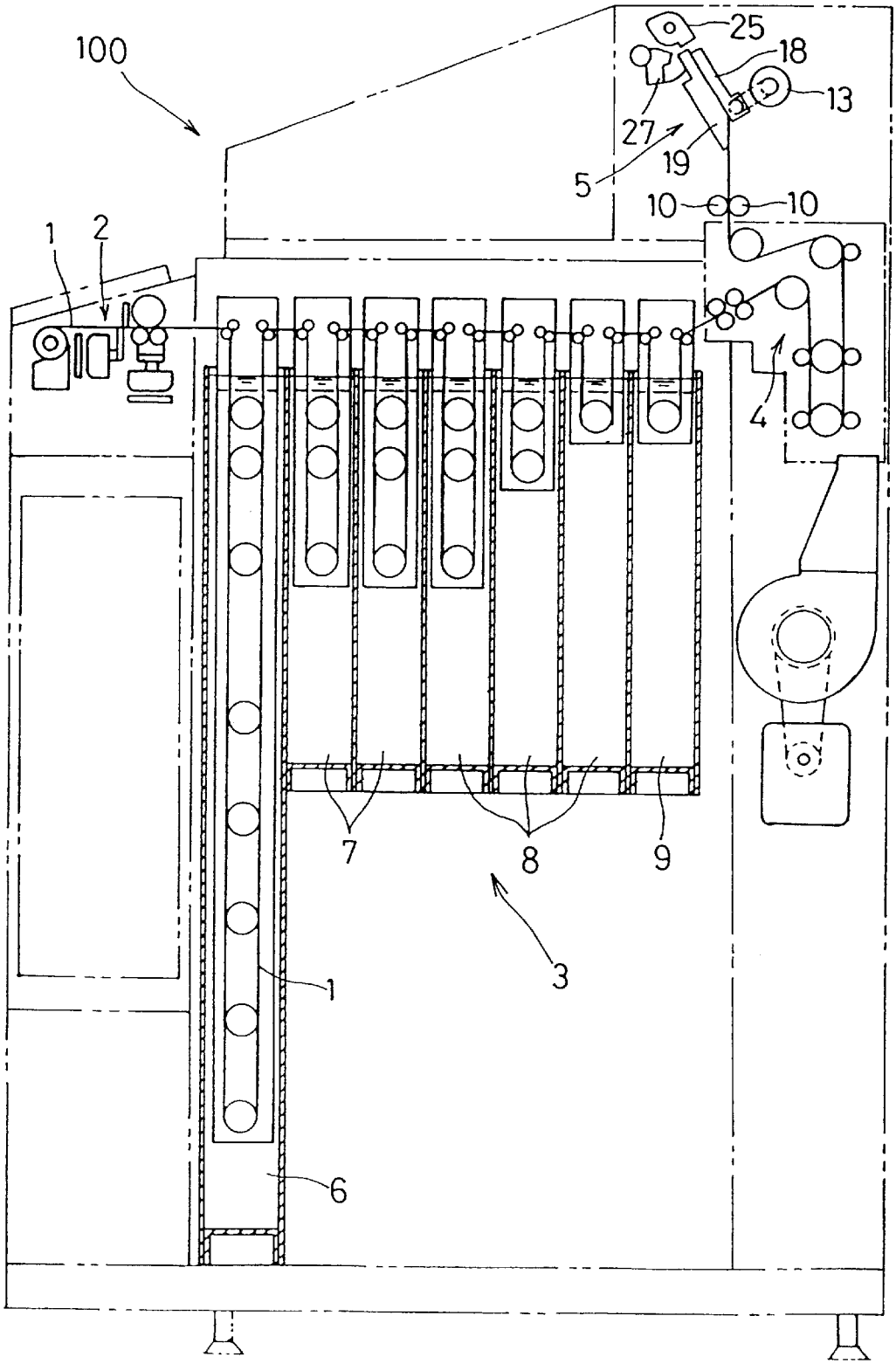
FIG. 1 is a side view showing an entire construction of a photographic developing system.

As shown in FIG. 1, a photographic developing system 100 includes a film charging section 2 for charging a photographic film (to be referred to as 'film' hereinafter) as an example of photosensitive material, a film developing section 3 for developing the film 1 fed from the film charging section 2, a film drying section 4 for drying the developed film 1, and a film cleaning section 5 for cleaning the dried film 1.

The film developing section 3 includes total of seven developing tanks storing plural kinds of developing liquid for effecting a series of developing process consisting of color development, bleaching, fixing and stabilizing. Specifically, the seven tanks consist of, from the upstream side, one color developing tank 6, two bleaching tanks 7, three fixing tanks 8 and one stabilizing tank 9.

Figure 4:
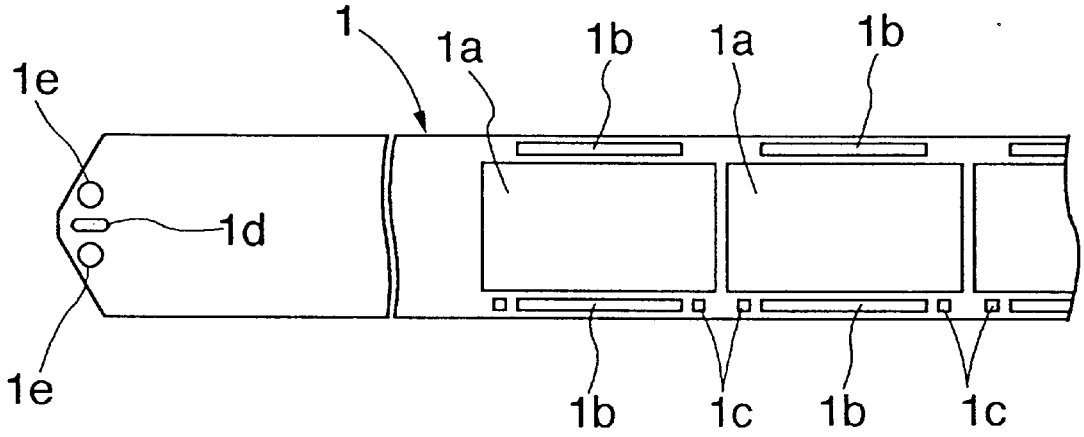
FIG. 4 is a plan view of a photographic film shown also in FIG. 3.
Figure 5:
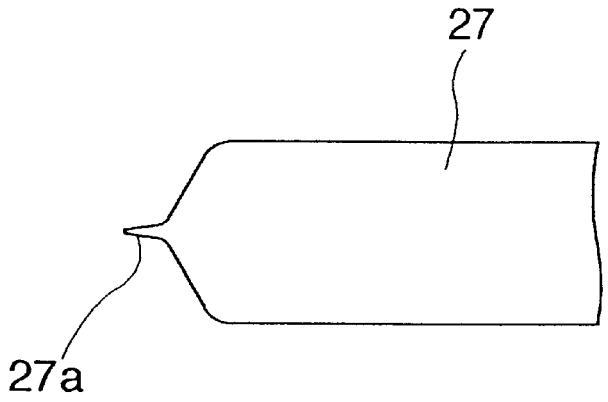
FIG. 5 is a plan view of principal portions of an attachment tool shown also in FIG. 2, FIGS. 6A, 6B are a flow chart illustrating a process of a cleaning operation.

Next, the film 1 will be described with reference to FIG. 4. The film 1 includes image recording areas 1*a*, a pair of upper and lower magnetic recording areas 1*b* disposed upwardly and downwardly of the image recording areas 1*a*, a feeding perforation 1*c*, and one elongate hole 1*d* and two round holes 1*e* which are formed at a longitudinal end of the film 1.

Next, a cleaning apparatus incorporated within the film cleaning section 5 will be described in details with reference to FIGS. 2 and 3.

First, on the upstream side of a transport passage of the film 1, there are disposed a pair of feed rollers 10, 10 are disposed, and on the downstream side of the passage there are disposed a support roller 15 and press rollers 11 which rollers 15, 11 are opposed to each other. The feed rollers 10 feed the film past the film drying section 4 to the support roller 15 and the press roller 11. As shown in FIG. 3, the press rollers 11 are provided as a pair in correspondence with the pair of magnetic recording areas 1*b* of the film 1. Further, these press rollers 11 are integrally mounted on a common shaft 12. The press rollers 11 are operatively connected via a belt 14 with a pulse motor 13 to receive drive force from this motor 13. The press rollers 11, 11 and the support roller 15 cooperate to transport the film 1 pinched therebetween. Each of the press rollers 11, 11 is formed by hardening stainless steel rollers with hard chromium plating treatment and finishing its peripheral face contacting the surface of the film 1 by buff finish. Instead, the roller may be formed by forming a ceramic layer on a surface of aluminum base material.

On the film transport passage between the feed rollers 10 and the press rollers 11, 11 (or the support roller 15), there is reserved a loop forming space 16 where a loop as denoted with an arrow B of the film 1 may be formed. And, within this loop forming space 16, there is provided a sensor 17 for detecting the condition of the loop formation. This sensor 17 consists essentially of a beam transmitter 17*a* and a beam receiver 17*b*.

On the downstream side relative to the press rollers 11, 11 (or the support roller 15) on the film transport passage, there are disposed a first guide member 18 and a second guide member 19. These first and second guide members 18, 19 cooperate to form a guide passage C therebetween for guiding the film 1. The press rollers 11, 11 and the support roller 15 are rotatably attached to the second guide member 19. Further, for allowing smooth introduction of the film 1 fed by the feed rollers 10 into the guide passage C, the second guide member 19 provides an inclined face 19*a*.

A roller cleaner 20 is disposed adjacent the press rollers 11, 11. An end face 20*a* of this roller cleaner 20 is constantly placed in contact with the press rollers 11, 11, so as to take off dust or the like adhered to the outer peripheral faces of the press rollers 11, 11. The roller cleaner 20 is formed by e.g. winding threads or cloth about felt material, and as shown in FIG. 3, the roller cleaner 20 is attached in such a manner the cleaner 20 is pressed against the peripheral faces of the press rollers 11, 11 by means of a cleaner retainer 21 and a screw 22 for threading the cleaner retainer 21 to the first guide member 18.

Adjacent the above-described roller clean 20, there is provided a sensor 23 for detecting e.g. a leading end of the film 1. This sensor 23 consists essentially of a beam emitter 23*a* attached to the first guide member 18 and a beam receiver 23*b* attached to the second guide member 19. Further, adjacent an exit of the guide passage C, a free roller 24 is rotatable attached to the first guide member 18.

At the downstream end of the film transport passage, a cartridge 25 is attached. Then, the film 1 discharged from the guide passage C is wound onto a spool 26 incorporated with the cartridge 25 to be stored therein. Further, for guiding the film 1 from the passage C into the cartridge 25, an attachment tool 27 is provided. This attachment tool 27 is pivotable about a shaft 28 and its pawl 27*a* formed at a leading end thereof is engageable with the elongate hole 1*d* formed at the longitudinal end of the film 1. The attachment tool 27 is normally maintained at a wait position shown in FIG. 2.

The operations of the above-described respective components of the cleaning apparatus are controlled by a control unit 30 including a microcomputer as a major component thereof. More particularly, the control unit 30 controls operations of a drive motor 31 connected with the feed rollers 10, the pulse motor 13 connected with the press rollers 11, 11, the attachment tool 27 and a further drive motor 32 connected with the spool 26 (the spool 26 and the drive motor 32 are an example of transport mechanism). The control unit 30 also receives output signals from the sensors 17, 23.

Figure 6A:
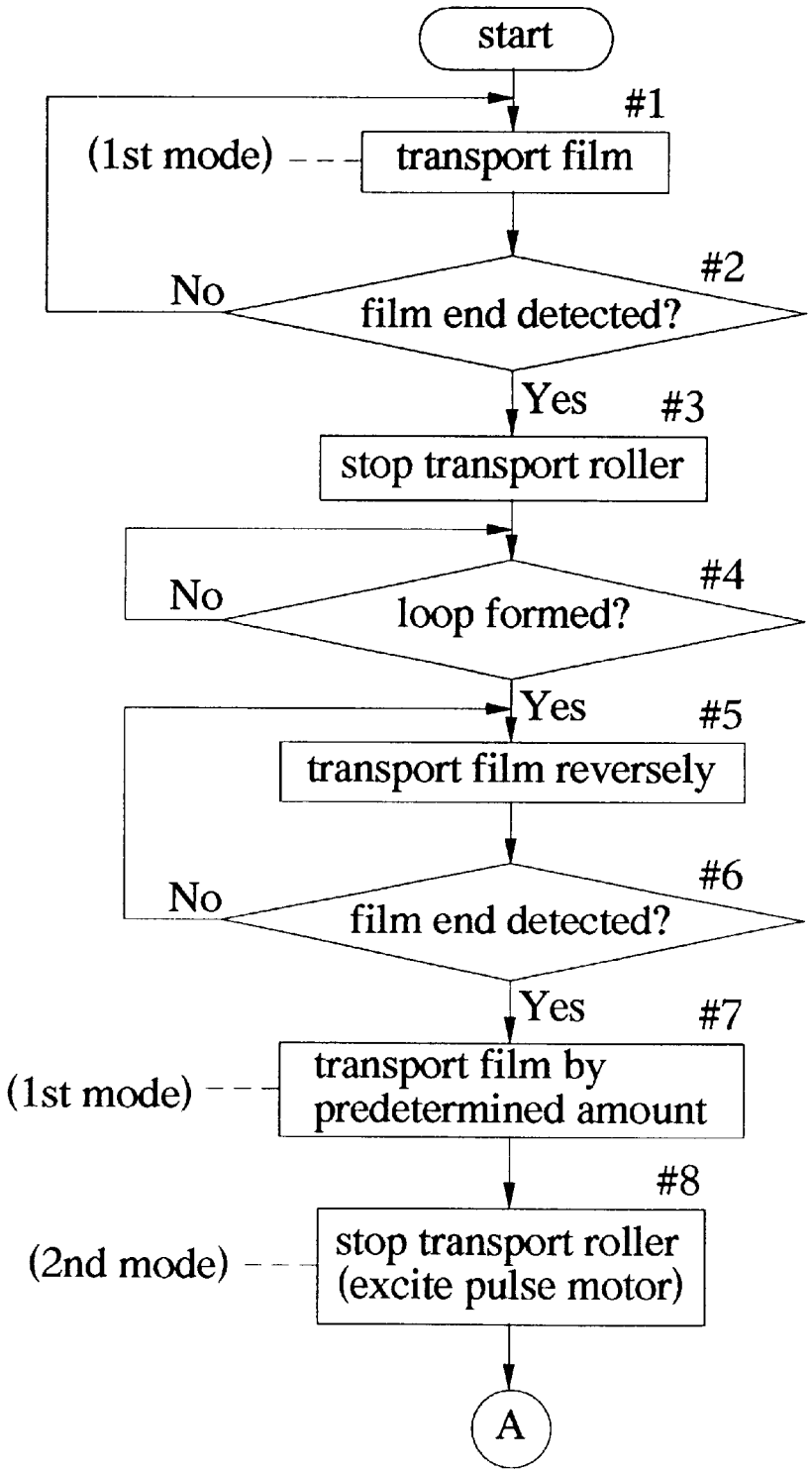
Figure 6B:
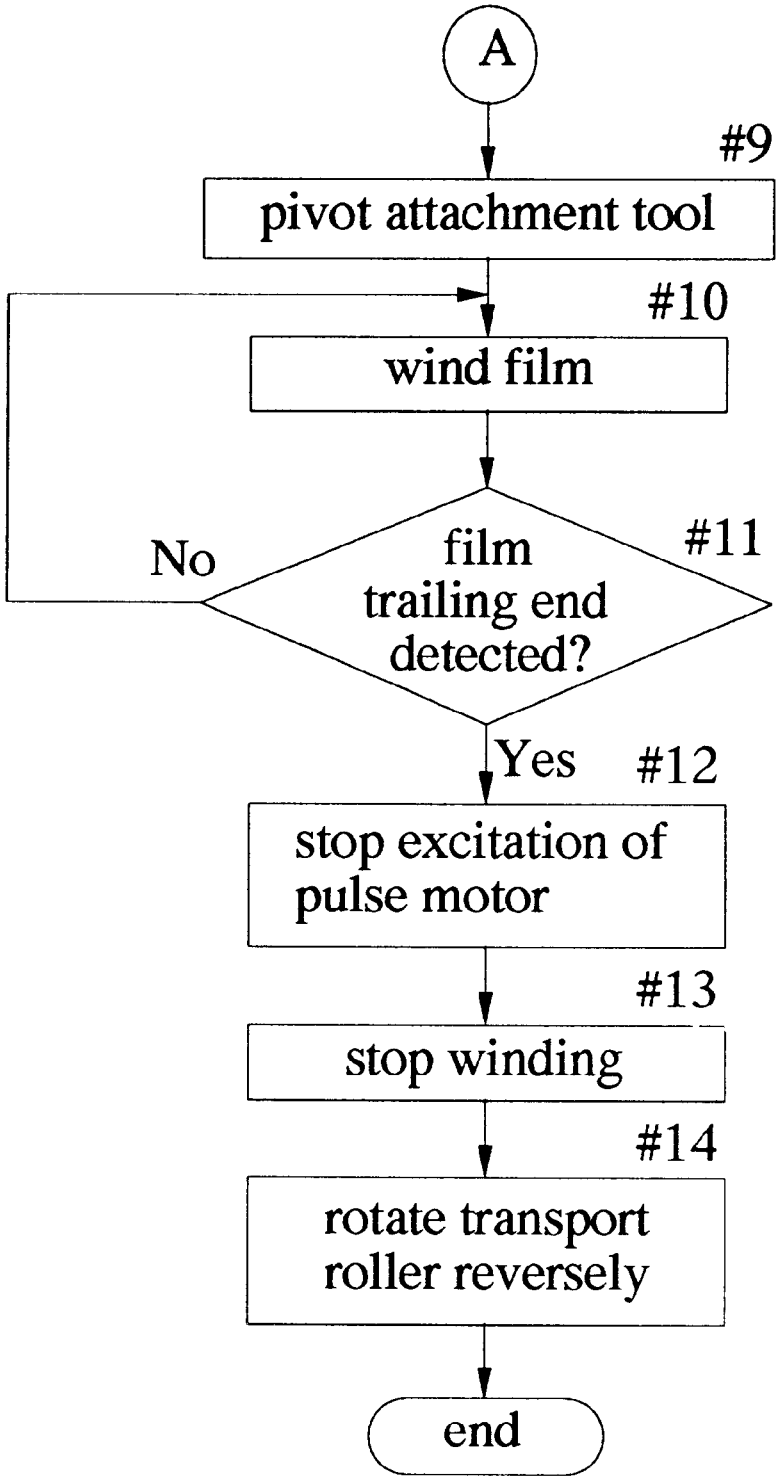

Next, the functions and operations of the cleaning apparatus will be described with reference to a flow chart of FIGS. 6A, 6B. First, the film 1 having passed the film developing section 3 and the film drying section 4 is transported by the feed rollers 10, the press roller 11, 11 and the support roller 15 (step #1). In this, the film 1 is transported linearly as denoted with an arrow A in FIG. 2. When the sensor 23 detects a leading end of the film 1 (step #2), the pulse motor 13 is magnetically excited to stop the press rollers 11, 11. In this, as the feed rollers 10 are still rotating, a loop of the film 1 is gradually formed within the loop forming space 16. Then, when the sensor 17 detects formation of a film loop of a predetermined size (step #4), the press rollers 11, 11 are reversely rotated (in the direction of arrow E in FIG. 2) to transport the film 1 in the opposite direction (step #5). This reverse transportation of the film 1 is effected for the following reason. Namely, after the sensor 23 has detected the leading end of the film 2 at step #2, this leading end of the film 1 is slightly moved in the feeding direction during the loop formation at step #4. Thus, by detecting the position of the leading end of the film 1 again, this position may be determined more accurately, whereby the engagement between the film 1 and the pawl 27*a* of the attachment tool 27 (this engagement will be detailed later) may take place more reliably.

Now, as the film is transported reversely and the sensor 23 again detects the leading end of this 1 (step #6), next the press rollers 11 are rotated forwardly (in the direction of arrow D in FIG. 2) to transport the film 1 to a predetermined position in the vicinity of the fee roller 24. The amount of this transportation is predetermined, and this amount can be controlled to be constant by appropriately controlling the number of drive pulses supplied to the pulse motor 13.

When the film 1 has been transported by the predetermined amount, the press rollers 11 are stopped (step #8). This is done by magnetically exciting the pulse motor 13, rather than simply cutting off power supply to this motor 13. Specifically, the power current is allowed to supply only to a predetermined one of stators of the pulse motor 13 so as to generate a magnetic filed between the stator and the rotor of the motor. With this generation of magnetic field, there is obtained a braked condition of the motor in which the motor cannot be rotated easily against external force tending to rotate the motor shaft.

Figure 2:
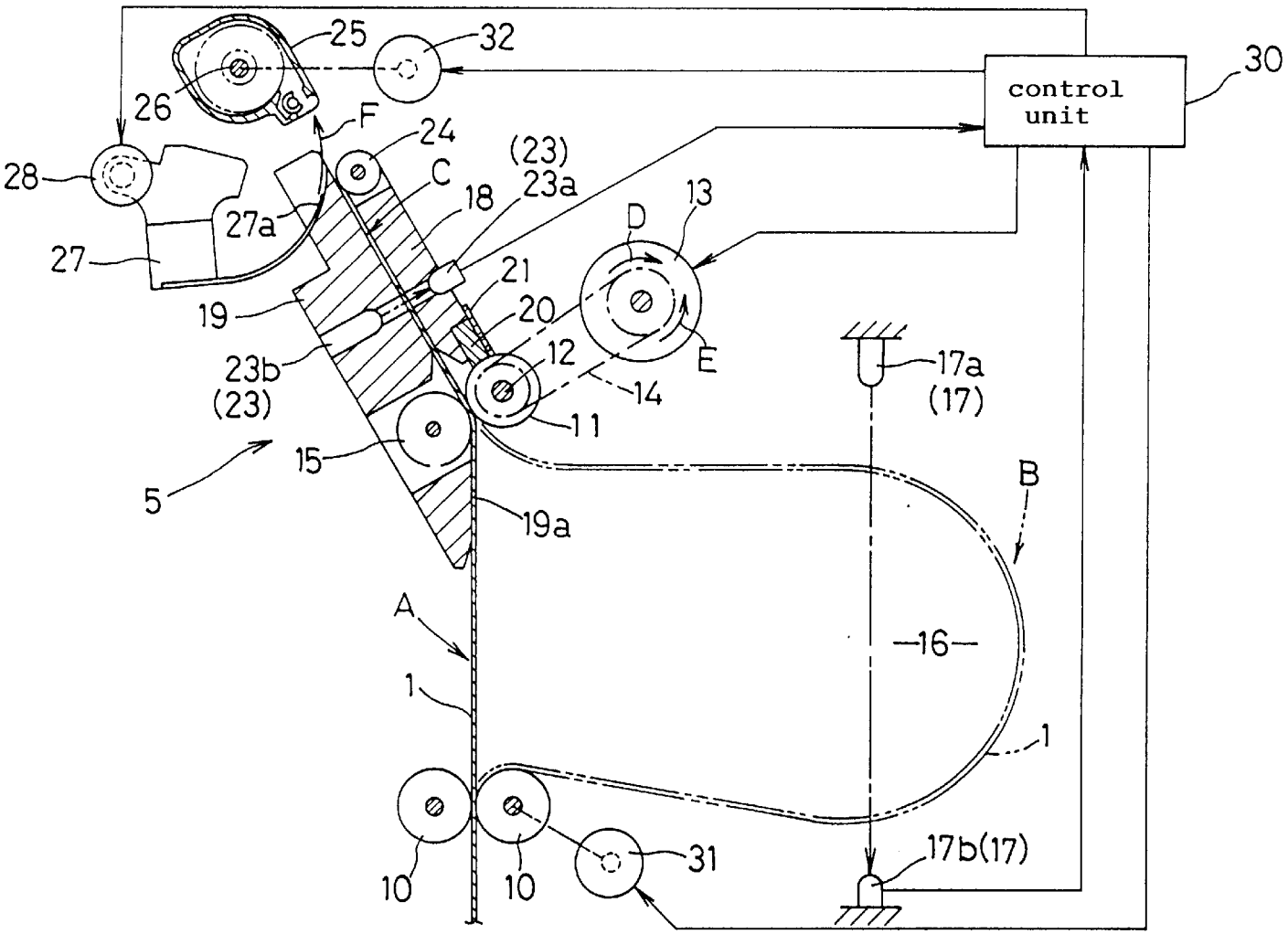
FIG. 2 is a side view showing a cleaning apparatus relating to the present invention.
Figure 3:
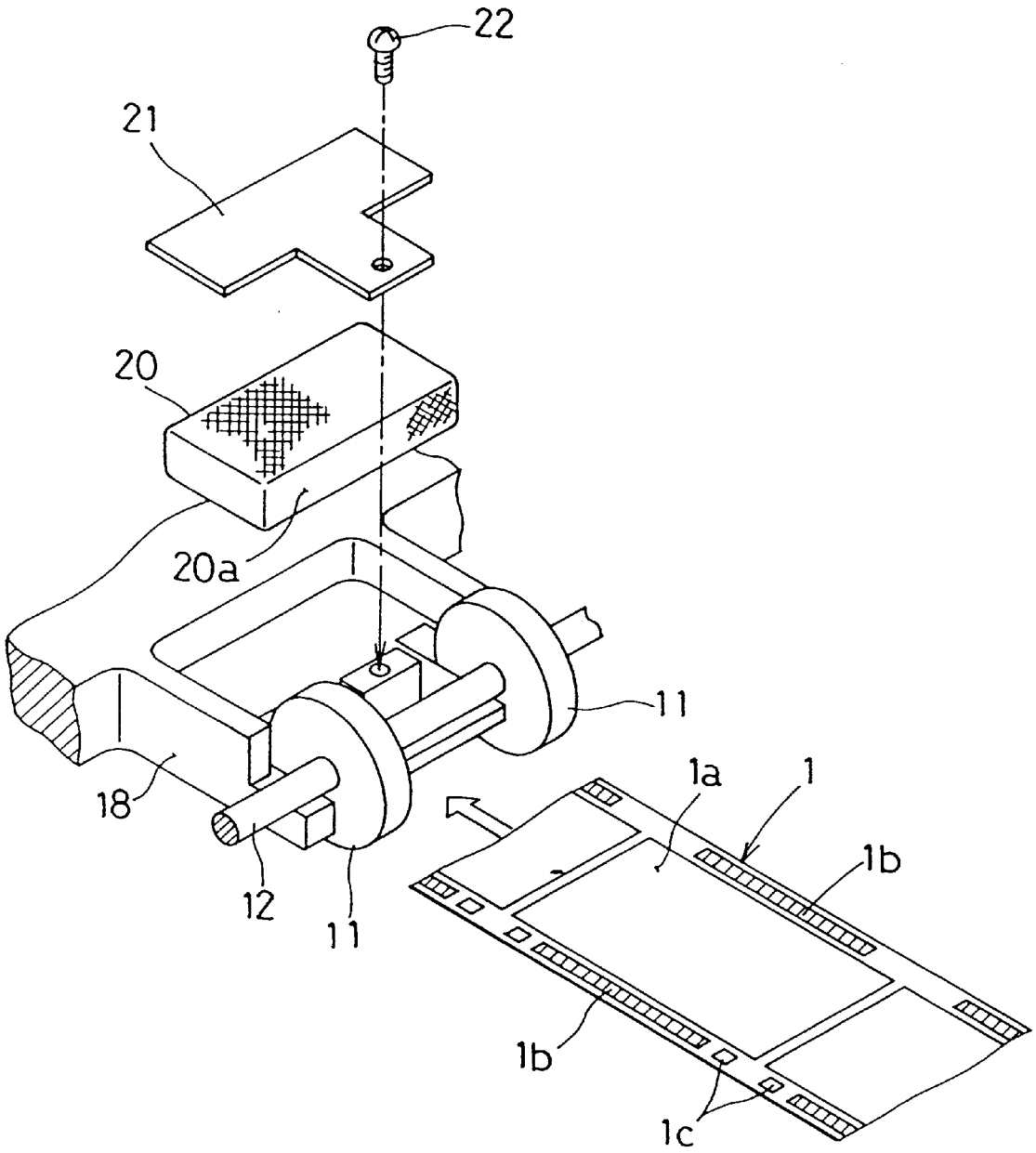
FIG. 3 is a perspective view showing principal portions of the cleaning apparatus of FIG. 2.

Next, when the attachment tool 27 is pivoted in the direction of arrow F in FIG. 2 (step #9), the pawl 27*a* thereof comes into engagement with the elongate hole 1*d* formed at the longitudinal end of the film 1, whereby the film 1 is guided into the cartridge 25. Then, when the leading end of the film 1 comes into engagement with the spool 26 inside the cartridge 25, the attachment tool 27 is returned to the wait position, and then the spool 26 is rotatably drive by the drive motor 32 to initiate a winding operation of the film 1 (step #10).

During the above-described transportation of the film 1 by the spool 26, the press rollers 11, 11 are maintained still. That is, in association with the transportation of the film 1 by the means of the spool 26, there is generated friction between the surface of the film 1 and the surfaces of the press rollers 11, which friction tends to rotate the press rollers 11, 11 in the forward direction. However, as the pulse motor 13 is subjected to the braking force as described hereinbefore, the press rollers 11, 11 cannot be rotated easily. Therefore, due to the friction generated between the press rollers 11, 11 and the surface of the film 1, dust adhered to the surface of the film 1 is transferred on to the press rollers 11, 11. In this manner, the cleaning operation of the film 1 is effected. As the press rollers 11, 11 are disposed in the positions corresponding to the respective magnetic recording areas 1*b* as shown in FIG. 3, the dust adhered to these magnetic recording areas 1*b*, in particular, is automatically removed therefrom. In this manner, the cleaning operation of the film 1 is effected simultaneously and in association with the take-up storing operation of the film 1 into the cartridge 25.

Thereafter, when the sensor 23 detects a trailing end of the film 1 (step #11), the supply of magnetic excitation to the pulse motor 13 is ceased (step #12). With lapse of a predetermined time period required for storing the entire film 1 into the cartridge 25 after the timing of the detection of the trailing end of the film 1, the power supply to the drive motor 32 is cut off to stop the winding operation by the spool 26 (step #13). Incidentally, when the film 1 is wound by rotating the spool 26 at a constant rotational speed, the peripheral speed of the spool 26 varies in accordance with the take-up amount of the film about the spool 26, that is, the transporting speed of the film 1 varies. Then, in order to cope with such speed variation also, it is preferred that the above-described loop of the film 1 be formed. That is, there inevitably occurs a difference between the transport speed (maintained constant) of the film 1 by the feed rollers 10 and the transport speed of the film 1 by the spool 26. Thus, if the film 1 is maintained under the linear state as denoted with the mark A in FIG. 2, in a later phase of the winding operation by the spool 26, the transporting speed of the film 1 by the spool 26 will exceed the transporting speed by the feed rollers 10, thereby to apply an excessive tension to the film 1. Then, if the loop of the film is formed in advance, such phenomenon may be solved or at least mitigated.

After the winding operation is stopped, the press rollers 11, 11 are reversely rotated for about 1 to 2 rotations (step #14). With this, the dust collected on the surfaces of the press rollers 11, 11 is automatically taken off by the roller cleaner 20. This roller cleaner 20 may be periodically replaced by a new one.

The above-described series of operations are controlled by the control unit 30, which selectively provides a first mode (steps #1, #7) for transporting the film 1 in association with the forward rotation of the press rollers 11, 11 and a second mode (step #8) for effecting the dust removing operation of the film 1 with maintaining the press rollers 11, 11 still.

Next, other embodiments of the invention will be specifically described.

Figure 7:
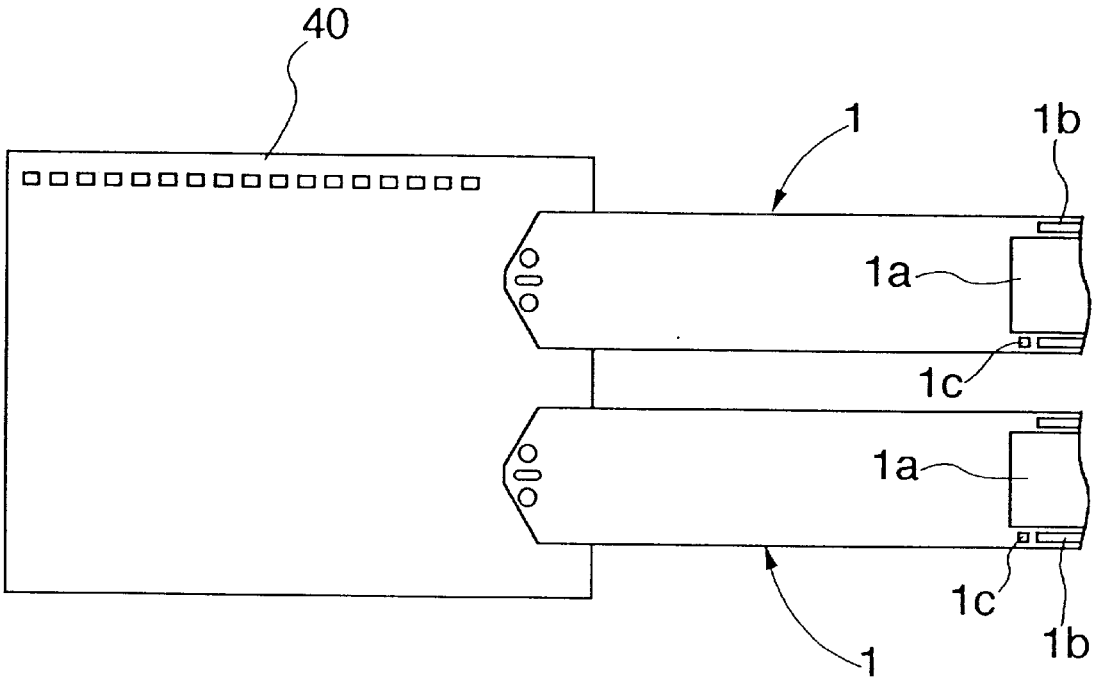
FIG. 7 is a plan view showing a sample connection condition between a leader and a film.

(1) In the foregoing embodiment, the film 1 is stored into the cartridge 25. The cleaning apparatus of the invention may be used also when a leader 40 is affixed to the film 1 by means of a tape and the film is developed tinder this condition. Incidentally, the leader 40 may be connected with one roll of film 1 or a plurality of rolls of films as illustrated in FIG. 7.

(2) The cleaning apparatus according to the present invention may be incorporated within a photographic printing system, rather than the photographic developing system.

(3) In the foregoing embodiment, the cleaning operation is effected on the magnetic recording areas 1*b* of the film 1. Instead, the cleaning operation may be effected on the entire width of the film 1.

(4) In the foregoing embodiment, the press rollers 11, 11 are maintained still in the second mode. The dust cleaning operation is possible also by rotating the press rollers 11, 11 at a speed higher or lower than the transport speed of the film 1. The dust cleaning operation is further possible by reversely rotating the press rollers 11, 11.

(5) In the foregoing embodiment, the pulse motor 13 is employed for driving the press rollers 11. Instead, a standard direct-current motor may be employed. In this case, in order to provide the magnetic excitation, such a current should be provided to the direct-current motor as not rotate the motor, just like the case of the pulse motor 13.

(6) The press rollers 11, 11 may be stopped by other mechanical means also.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A cleaning apparatus for cleaning photosensitive material transported by a transport mechanism, which comprises:

a support portion for supporting the photosensitive material from a back side thereof;

a press roller rotatable relative to the support portion for pressing the photosensitive material against the support portion;

drive means for rotatably driving the press roller; and control means for controlling rotational drive of the drive means, the control means selectively providing a first mode where the photosensitive material is transported in association with rotation of the press roller and a second mode where a peripheral speed of the press roller is rendered different from a transport speed of the photosensitive material by the transport mechanism.

2. A cleaning apparatus as defined in claim 1, wherein in the second mode, the peripheral speed of the press roller is rendered substantially zero.

3. A cleaning apparatus as defined in claim 2, wherein the drive means for driving the press roller is an electric motor, and the peripheral speed of the press roller is rendered substantially zero by applying magnetic excitation to the electric motor.

4. A cleaning apparatus as defined in claim 1, further comprising a feed roller disposed upstream of the press roller in a transport passage of the photosensitive material along which the material is transported by the transport mechanism, and before the cleaning operation of the photosensitive material in the second mode, the control means drives the feed roller while maintaining the press roller still, so as to form a loop of the photosensitive material.

5. A cleaning apparatus as defined in claim 4, wherein the photosensitive material is stored into a cartridge attached to a terminal end of the transport passage, and a dust cleaning operation is effected in association with this storing operation of the material into the cartridge.

6. A cleaning apparatus as defined in claim 5, wherein the transport mechanism is a drive mechanism for rotatably driving a shaft of the cartridge to which one end of the photosensitive material is connected.

7. A cleaning apparatus as defined in claim 1, further comprising a roller cleaner for taking off the dust collected on the outer peripheral face of the press roller.

8. A cleaning apparatus for cleaning photosensitive material, which comprises:

a transport mechanism for transporting the photosensitive material;

a support portion for supporting the photosensitive material from a back side thereof;

a press roller rotatable relative to the support portion for pressing the photosensitive material against the support portion;

drive means for rotatably driving the press roller; and control means for controlling rotational drive of the drive means, the control means selectively providing a first mode where the photosensitive material is transported in association with rotation of the press roller so as to connect one end of the photosensitive material with a spool of the transport mechanism and a second mode where a peripheral speed of the press roller is rendered different from a transport speed of the photosensitive material by the transport mechanism after execution of the first mode.

* * * * *